United States Patent [19]

Tucker

[11] 4,112,650

[45] Sep. 12, 1978

[54] METHOD OF PREVENTING CONTAMINATION OF BEVERAGE CONTAINERS

[76] Inventor: Hubert J. Tucker, 6600 Marguerite La., Little Rock, Ark. 72201

[21] Appl. No.: 801,340

[22] Filed: May 27, 1977

Related U.S. Application Data

[63] Continuation of Ser. No. 639,447, Dec. 10, 1975, abandoned.

[51] Int. Cl.[2] ..... B65B 3/00; B65B 55/00; B65B 61/18

[52] U.S. Cl. ..... 53/412; 53/467

[58] Field of Search ..... 53/14, 29, 37; 113/120 Q, 121 C; 206/459, 628, 634; 220/265–273

[56] References Cited

U.S. PATENT DOCUMENTS

| | | | |
|---|---|---|---|
| 1,797,868 | 3/1931 | Kelchner | 206/459 X |
| 3,202,448 | 8/1965 | Stern et al. | 206/216 X |
| 3,354,603 | 11/1967 | Katzew et al. | 53/37 X |
| 3,403,811 | 10/1968 | Moller et al. | 220/373 |
| 3,404,800 | 10/1968 | Arfert | 220/269 |
| 3,627,171 | 12/1971 | Kaplow | 220/270 X |
| 3,981,119 | 9/1976 | Schultz | 53/37 |

*Primary Examiner*—Robert Louis Spruill
*Attorney, Agent, or Firm*—Roy C. Hopgood; John M. Calimafde; Charles W. Neill

[57] ABSTRACT

Beverage containers are commonly made with a ring at the top of the can for pulling a knock-out from the can top to provide a discharge opening through which a person can conveniently drink the contents of the can, or pour them into a glass or cup. The can top gathers dust and other contaminants that are a health hazard. This invention locates the discharge outlet at the bottom of the can and in a recessed compartment, and prevents contamination by closing off access to the can bottom by a shelf or other surface on which the can rests, so that the can itself acts as a shield to protect the discharge outlet area from contaminants.

8 Claims, 7 Drawing Figures

FIG. 1.
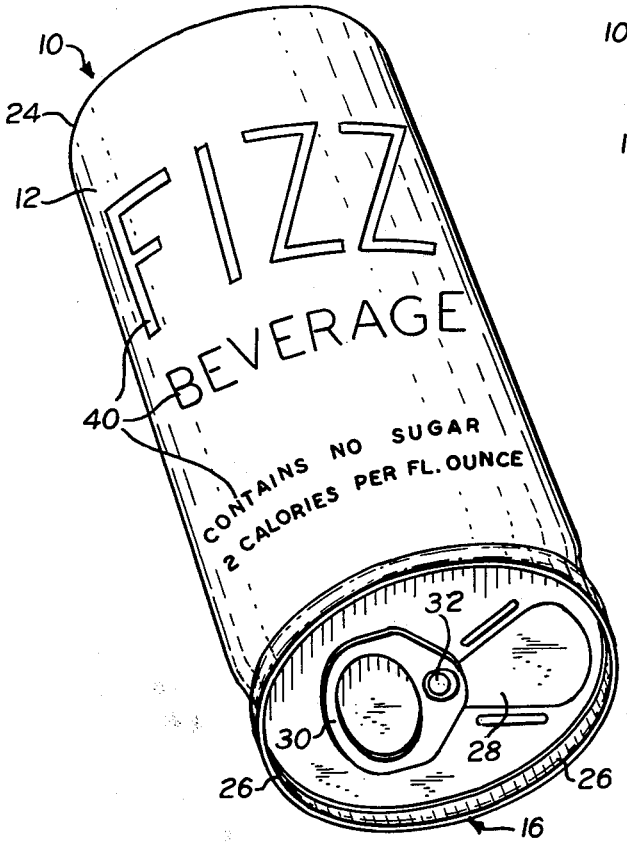
FIG. 2.
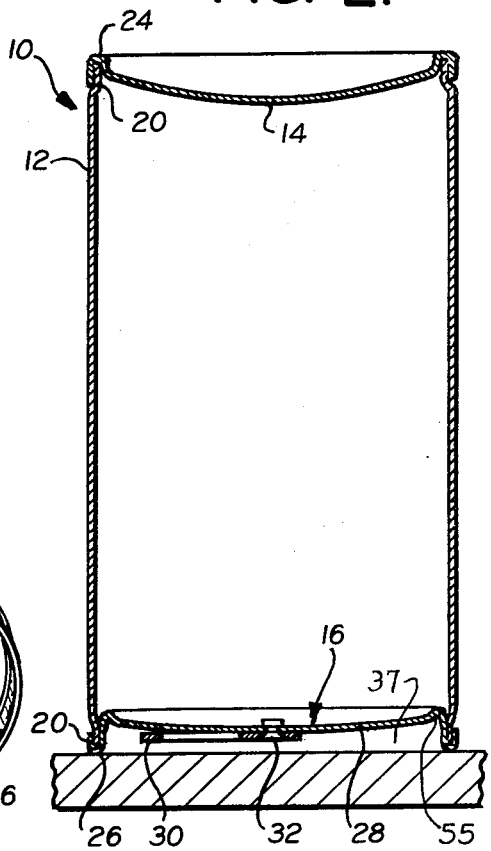
FIG. 3.
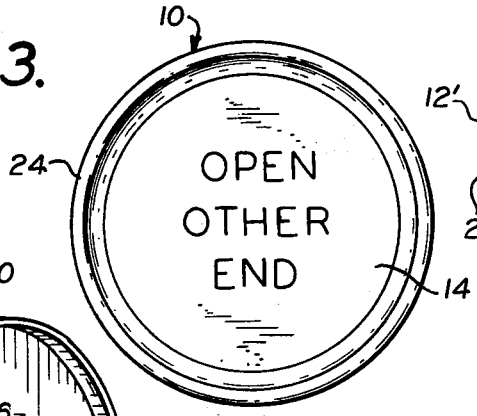
FIG. 6.
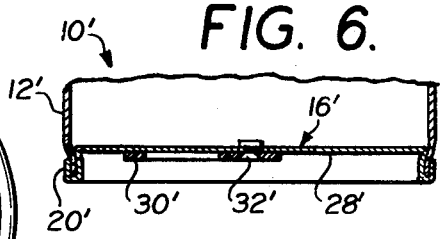
FIG. 4.
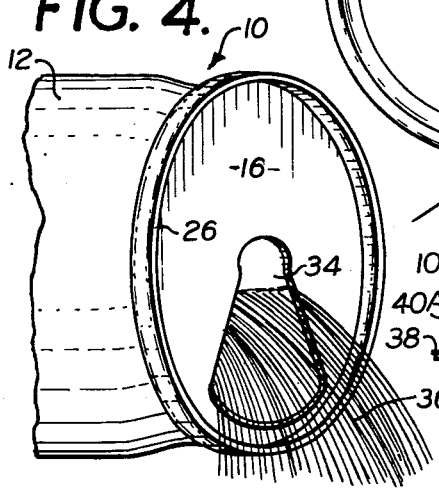
FIG. 5.
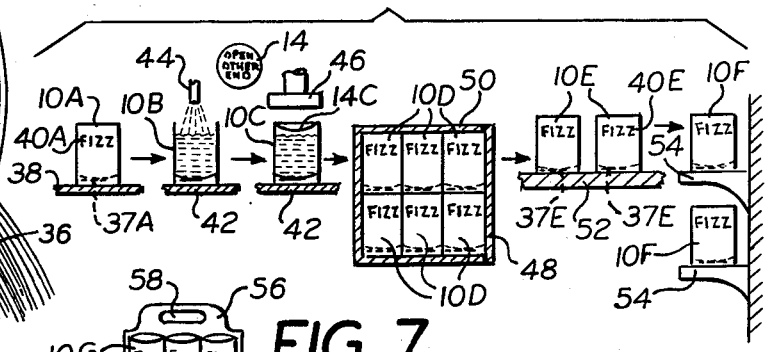
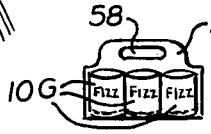
FIG. 7.

METHOD OF PREVENTING CONTAMINATION OF BEVERAGE CONTAINERS

RELATED PATENT APPLICATIONS

This application is a continuation of my application Ser. No. 639,447, filed Dec. 10, 1975 for Method of Preventing Contamination of Beverage Containers, now abandoned; and it is related to my application Ser. No. 516,113, filed Oct. 18, 1974, now abandoned.

BACKGROUND AND SUMMARY OF THE INVENTION

Beverage containers frequently have provision for opening a portion of the top of the can so that the purchaser can drink the contents directly from the can. The area that is to serve as the discharge opening is formed as a "knock-out" in the metal top, and a ring is secured to the knock-out near the center portion of the can top for tearing the knock-out from the can top so as to provide the discharge opening. Such containers have the disadvantage that the top of the can becomes dirty as the result of dust settling on it or other contaminants falling on it while it is standing on store shelves or elsewhere. Sometimes insecticides are sprayed on areas where the cans are stored, and this insecticide accumulates and dries on top of the can. People who buy these containers often open them for immediate consumption and without either the facilities or the inclination to wash the container before bringing their lips in contact with the contaminated surfaces.

Health authorities in some jurisdictions require that such self-opening containers have a plastic cover over the area around the discharge opening for protection from contamination. Such plastic covering adds considerable expense to preparation of the containers for sale; and the equipment for applying such plastic covers is a large expense to plants where beverage containers are filled and packed. Furthermore, such plastic covers are not adequate for preventing contamination, because customers have favorite flavors and they break open several packs on the supermarket shelf and collect different favorite individual flavors which they purchase at the check-out counter.

Store managers cannot effectively prevent this practice and the unsold containers remain on the store shelf with some or all of the containers deprived of their protection against dust, dirt and other contamination. Some of the containers that are purchased are stored on pantry shelves and elsewhere where they gather dust and dirt with no protection whatever for the areas around the discharge opening.

This invention provides a method for protecting the drinking orifice area of a pull-tab beverage container from dust, dirt, sprays and similar contaminants during packing, merchandising display in stores, and while on a shelf in a purchaser's pantry or other storage area.

The new result obtained by this invention provides the protection against contamination without using plastic covers, or any other kind of protective cover; and with no increase in the cost of the beverage and container. The invention uses the container itself as a protective cover for preventing dust, dirt, sprays and like contaminants from coming in contact with the area of the container around the discharge opening from which a person drinks or pours the contents from the container.

The method of this invention makes a container with a side wall and a bottom wall secured to the side wall, and positions the bottom wall with a substantial part thereof recessed upward above the lower end of the side wall so that the bottom wall and side wall form a compartment below the bottom wall and above a plane on which the side wall rests when the container is on a shelf or other support. The compartment is closed off in all directions when the lower end of the container is supported on a shelf, table or other conventional flat support.

Since a container, such as a beverage can, is stable when either end is resting on a shelf, this invention insures that the container is oriented with the pull-tab containing recess at the bottom by placing lettering of the container label so that the lettering is upright only whent the pull-tab recess of the container is at the bottom.

Other objects, features and advantages of the invention will appear or be pointed out as the description proceeds.

BRIEF DESCRIPTION OF DRAWING

In the drawing, forming a part hereof, in which like reference characters indicate corresponding parts in all of the views;

FIG. 1 is an isometric view of a beverage container for use in the method of this invention;

FIG. 2 is a sectional view taken on a diametrical plane through the container as shown in FIG. 1;

FIG. 3 is a plan view of the top of the container shown in FIGS. 1 and 2;

FIG. 4 is a fragmentary view showing the way in which the contents can be poured from the container shown in the other views;

FIG. 5 is a diagrammatic view illustrative of the method of this invention;

FIG. 6 is a detail, sectional view of a modified container structure that can be used for the method of this invention; and FIG. 7 is a diagrammatic view of a six-pack of the type which are frequently broken up in stores by customers who want to select their favorite flavors from a number of different packs.

DESCRIPTION OF PREFERRED EMBODIMENT

The method of this invention is best suited to beverage containers which are cylindrical metal cans; and the method will be described in connection with such containers. FIGS. 1 and 2 show a beverage container 10 which has a side wall 12 and end walls including a top 14 and a bottom 16. These end walls 14 and 16 are secured to the side wall 12 at seams 20 which are of different constructions on different types of cans, the seams shown in FIG. 2 being merely illustrative of connections between the end walls of a metal beverage container and the side wall of the container.

In the construction shown, the connections of the end walls to the side wall leave rims 24 and 26 at the upper and lower ends respectively of the container. In order to increase the ability of the container to withstand pressure of a carbonated beverage, the end walls 14 and 16 are preferably made with a concavo-convex shape over most of their area, as shown in FIG. 2.

Since most customers expect to see the knock-out opening and pull tab on the top of a beverage container, the container of this invention is made with a designation on the top wall 14 that the other end of the container should be opened. This alerts the customer to the fact that the container is a self-opening can, even though it does not look like one.

FIG. 3 shows the top wall 14 with letters designating the other end of the container as the one to be opened. Without this, the customer might think that there was no provision for opening the container except a can opener or a punch such as are commonly referred to as a "church key."

The bottom 16 is made with a knock-out 28 which extends from a center region of the bottom to a region adjacent to the rim 26, as clearly shown in FIG. 1. A pull tab 30 is secured to the knock-out at a region 32 and should be secured tightly enough, as by welding, to permit the knock-out 28 to be torn from the bottom 16 by pulling the end of the tab 30, which is remote from the connection 32, in a direction away from the bottom 16.

Removal of the knock-out leaves a discharge opening 34 in the bottom 16 from which a beverage 36 can be poured, as shown in FIG. 4; or from which a person can drink directly from the can. When poured as shown in FIG. 4, the beverage 36 flows over the arcuate edge of the opening 34 and has a minimum of contact with any outside surfaces of the can. Even when the contents are to be poured from the can, as in FIG. 4, however, it is usual to hold the can in a fixed position and upside down while pulling the knock-out from the end of the can. Cans filled with carbonated beverages often have the beverage foam up through the opening 34 as the knock-out is pulled from the opening, and this foaming beverage spreads out over the bottom wall 16 and would become contaminated if the surface 16 were not protected from contamination.

When a customer opens the can and drinks directly from the can. his lips contact with the surface of the end of the can adjacent to the discharge opening 24. With the usual self-opening beverage can which has the knock-out in the top wall, anyone drinking directly from the can consumes some of the dust, dirt, insect spray residue and other contaminants that lodge on the top surface of the can when the can stands with the top surface having no protection from the ambient atmosphere.

In accordance with the method of this invention, the beverage can 10 is made with the knock-out 28 in the bottom wall 16, and this bottom wall is shaped, as shown in FIG. 2, so that it is set back from the lower limits of the side wall 12 so as to provide a compartment 37 which is defined by the bottom wall 16, the structure at the lower end of the side 12 of the can, and by a plane that passes through the bottom edge of the side wall structure. A top surface of a shelf 38, on which the can 10 is supported, constitutes such a plane.

The compartment 37 is made deep enough so that no part of the bottom wall 28 or the ring 30 contacts with a supporting shelf 38.

The can 10 is made with the lower structure of the side of the can imperforate, and the bottom surface of the rim 26 located in a plane, so that when the can is resting on a shelf 38 or other flat supporting surface, the interior of the compartment 37 is shut off from any contact with the ambient atmosphere. Thus the can itself provides a cover or shield for preventing any dust, dirt, spray or other contamination from reaching the outside surface of the bottom of the can.

The side wall 12 of the container 10 has lettering 40 which is oriented so as to be upright when the container is standing with the top wall 14 uppermost. This causes persons placing loose cans on a shelf to always place the can so that the end with the knock-out and pull tab will be at the bottom of the can and at a location protected from contamination.

Sometimes beverage cans have lines of small print extending in an up and down direction on the side of the can. Such print does not designate which end of the can is top or bottom, and for purposes of this invention it is important that the lettering on the side of the can must have at least the predominant part of it oriented so that the lettering is right side up only when the container is oriented with its bottom end lowermost. So long as this lettering is so oriented, persons handling the cans will instinctively place the cans so that the end of the can with the compartment 37 is always lowermost and the compartment closed off from the ambient atmosphere by the shelf, carton bottom, or other surface on which the can is placed.

The conventional practice is to make cans with the bottom of the can open and then fill the cans through the open bottom with the can upside down on the conveyor of the filling machine. The machine closes and seals the cans and then turns them over before placing them in the shipping cartons. The method of this invention changes this procedure and fills the cans from the top, applies the top, and packs the containers without turhing them over.

The containers are clean during filling and when they leave the filling plant. The recesses at the lower ends of a bottom layer of containers are protected by the bottom surface of the shipping carton; and the bottom surfaces of an upper layer of containers are protected by the clean top surfaces of the bottom layer.

FIG. 5 shows various steps of this invention. A can 10A is made with recess 37A at the bottom of the can and with lettering 40A on the side of the can and oriented so that it reads right side up only when the recess 37A is lowermost.

A can 10B is shown in the filling machine at a filling plant where the can 10B travels on a conveyor 42 of a filling machine. The can 10B is filled from the top by a nozzle 44 of the filling machine.

The can top 14 with lettering on it, as shown in larger scale in FIG. 3, is then supplied to can-closing apparatus 46 of the filling machine and the filled can is closed by the top, as indicated by the reference character 14C in FIG. 5.

Without turning the cans over, each can 10D is shifted to a shipping carton 48 where a first layer of cans 10D are deposited on the bottom wall of the shipping carton 48; and when using a "double case" of 48 cans, a second layer of cans 10D is placed on top of the lower layer and the carton closed and sealed by a top 50.

When the shipping carton 48 is unpacked, cans 10E are removed from the carton and placed on a store shelf 52 for merchandising display or for temporary storage. Because of the orientation of the lettering 40E, the person unpacking the cans instinctively places them on the shelf 52 with the can recesses 37E closed by the top surface of the shelf 52.

Cans 10F purchased by customers are carried home and those which are not used immediately are stored on pantry shelves 54.

Sometimes beverage containers are sold in groups of six or eight connected together by a carrier 56 (FIG. 7) with a hand-hold 58, through which a person can insert the fingers of a hand to conveniently carry the "six-pack" or "eight-pack." Individual containers in the holder 56 of FIG. 7 are indicated by the reference character 10G.

The prior art has endeavored to protect containers from contamination when assembled in a six-pack or an eight-pack by having the material of the pack cover the exposed top surfaces of the containers. This has not provided adequate protection for the containers, however, because customers break packages open to select favorite flavors, as already explained. This leaves the tops of the selected cans with no protection, and the rejected cans that are left on the shelf may or may not have any protection left after the pack has been broken open.

FIG. 6 shows a modified construction for the bottom of the container. Instead of being concavo-convex for most of its area, the bottom in FIG. 6, indicated by the same reference character as in the other figures but with a prime appended, is flat. Other structure in FIG. 6, corresponding to the structure in the other figures, is indicated by the same reference characters with a prime appended.

The bottom in FIG. 6 is set back from the rim at the bottom of the side wall so that all of the area of the bottom, except the rim, is supported above and out of conact with any underlyin surface on which the container is supported.

Referring again to FIG. 2, the bottom 16 is connected with the lower end of the side wall 12 by a rolled seam which is made by a process that requires a sharp bend where the circular portion of the bottom meets the side wall. This sharp bend results in recess 55 which is circular in extent and which has a radius a curvature, in a radial direction, which is extremely short. The recess 55 is, therefore, difficult or impossible to clean by merely wiping the bottom of the can because wiper does not fit into the narrow recess.

Various changes and modifications can be made in the described invention and some features can be used in different combinations without departing from the invention as defined in the claims.

What is claimed is:

1. The method of preventing contamination of the discharge end of a beverage container which has a tear out portion in one end of the container and means for tearing the tear out portion of the container to leave a discharge opening in the end of the container at a location where the surfaces of the container, adjacent to said opening, necessarily contact with the lips of a person drinking the beverage directly from said opening, said method comprising:

(a) locating the tearout portion in the bottom wall of the container and recessing the bottom of the container so that it forms a compartment between the container bottom and a plane determined by a bottom edge of a side wall of the container with the recess high enough above said plane so that the tear out portion and areas of the container bottom around the tear out portion are spaced from any flat surface on which the container is placed with the bottom of the container confronting said surface, (b) filling the container through the top thereof, and then closing and sealing the top of the container, (c) placing lettering on the side of the container with at least the predominant part of the lettering oriented so that the lettering is right side up only when the container is oriented with its bottom end lowermost, (d) storing and merchandising the container with the compartment containing the tear out portion at the bottom and closed by a surface on which the container rests and with the compartment containing the tear out portion and said means for tearing it protected from dust, dirt and insect sprays by the part of the container covering the compartment.

(e) displaying the conainer during merchanising with information displayed that said container opens at the bottom, and (f) continuing the protection of the tear out portion and its adjacent area from contamination after sale of each individual container by placing and supporting said container, even though separated from a merchandizing pack, on an underlying surface to thereby close said bottom compartment during storage by the purchaser while awaiting opening and discharge of the container through said discharge opening.

2. The method described in claim 1 characterized by filling the container through its upper end, closing the upper end of the container with an imperforate permanent top, lettering the container to indicate that the container is to be opened at its bottom, using the container itself as a shield to prevent dust, sprays and other airborne contaminants from reaching the recessed bottom located in said compartment, and holding the container upside down when removing the tear-out to open said discharge outlet.

3. The method described in claim 1 characterized by filling the container from the top, sealing the top of the container closed, and shipping the container with the lower end of the container resting on the bottom of a shipping carton and with the bottom recess spaced back from the bottom of the shipping carton.

4. The method described in claim 1 characterized by connecting a pull-tab to the tear-out for pulling the tear-out loose from the bottom of the container, and locating the pull-tab in an original position close to the bottom of the container and within the recess where it cannot touch a shelf on which the container is supported by contact of the shelf with the container structure at the lower end of the side wall of the container.

5. The method described in claim 1 characterized by making the lower end of the side wall imperforate with its lower edges located in a common plane so that when the can is standing on a flat shelf, the recessed compartment is shut off from communication with the ambient atmosphere.

6. The method described in claim 1 characterized by protecting from contamination the discharge ends of a plurality of beverage containers which contain beverages of different flavors, the containers being held together as a group by a common support by which the containers are carried as a pack, assembling all of the containers in the pack with the lower end of each container at the bottom of the pack, and equipping each container of the group with a recessed bottom structure and lettering of claim 1, so that a customer who breaks open packs of the containers in a store, to gather a group of containers filled with the customer's favorite flavor, will replace the rejected containers on the store shelf with the bottoms of the cans lowermost on the shelf and still protected from contamination by dust, dirt, sprays and other contaminants in the ambient atmosphere.

7. The method described in claim 1 characterized by making the container of metal and in the form of a cylindrical can, and of sufficient strength to resist the pressure of charged beverages placed in the container, and filling the can with charged beverage which may foam up from the discharge opening when the can is turned bottom-up and the tear-out is dislodged so that some of the beverage spreads over the uncontaminated surface of said recess.

8. The method described in claim 1 characterized by making the container of metal and in the form of a cylindrical can and with the bottom of the can secured to the lower end of the side wall thereof by a rolled seam, and with the bottom meeting the side wall around a bend that firms a circumferential recess which is of short radius from which it is difficult or impossible to wipe dust or dirt and other contamination because of the narrow cross section of said circumference.

* * * * *